United States Patent [19]

Frisbee et al.

[11] 4,248,311

[45] Feb. 3, 1981

[54] SIDE SHIFT BLADE ARRANGEMENT

[75] Inventors: Claude M. Frisbee, Bettendorf; Rudolf Horsch, Davenport, both of Iowa

[73] Assignee: J. I. Case Company, Racine, Wis.

[21] Appl. No.: 26,111

[22] Filed: Apr. 2, 1979

[51] Int. Cl.[3] ..... E02F 3/76

[52] U.S. Cl. ..... 172/819

[58] Field of Search ..... 172/801-809

[56] References Cited

U.S. PATENT DOCUMENTS

| | | | |
|---|---|---|---|
| 3,002,300 | 10/1961 | Turbyfill | 172/804 |
| 3,084,461 | 4/1963 | Beckford | 172/804 |
| 3,529,678 | 9/1970 | Teasdale | 172/804 |
| 3,670,825 | 6/1972 | Asal | 172/804 |
| 3,991,832 | 11/1976 | Cooper | 172/804 |

OTHER PUBLICATIONS

Model 850B, Crawler Tractor Parts Catalog pp. 258-261, 6/1977, Case Co., Racine, Wisc.

*Primary Examiner*—Richard J. Johnson

*Attorney, Agent, or Firm*—Cullen, Sloman, Cantor, Grauer, Scott & Rutherford

[57] ABSTRACT

A mechanism is disclosed for automatically laterally shifting a dozer blade to the exposed side of the tractor as the blade is angled to thereby keep the blade in front of the tractor and permit the use of a blade which is shorter than conventional angling blades. The lateral shift mechanism includes a slide plate support connected by a universal joint to the center bight portion of a C-shaped frame. The blade is mounted to the slide plate support by guide plates that permit the blade to slidably move along the longitudinal extent of the slide plate support when the blade is angled. A vertical mast support structure at the center of the bight portion of the frame mounts one end of extensible piston-cylinders used for angling, tilting, and pitching the slide plate support and blade. A slider bar is connected between the vertical mast and the blade for laterally shifting the blade when it is angled. One end of the slider bar is pivotally mounted to mounting structure on the mast and the other end is pivotally mounted to the back side of the blade through a cut-out portion in the slide plate support. The slider bar automatically forces the blade to move laterally on the slide plate support to the exposed side of the tractor when the blade is angled, and automatically centers the blade in front of the tractor when the blade is in the straight-ahead position. A piston-cylinder may be used instead of the slider bar when additional lateral movement of the blade is desired.

4 Claims, 3 Drawing Figures

SIDE SHIFT BLADE ARRANGEMENT

BACKGROUND OF THE INVENTION

The present invention relates to bulldozers or the like having transversely extending material moving blades, and more particularly to an improved and simplified mechanism for automatically shifting the blade laterally as the blade is angled, thereby permitting the use of a blade which is shorter than conventional angling blades.

It is known to provide in bulldozers or similar types of earthworking machines a pusher frame of C-shaped configuration which fits between the track frames or surrounds the front end of the tractor. The rear ends ofthe two arms of the C-shaped frame are pivotally connected to the sides of the tractor to permit raising and lowering of the C-shaped frame about a transverse axis thereby permitting lowering of the blade to a working position on the ground and raising of the blade for transport to another location.

Conventionally, the load handling blade is mounted on the earth moving equipment by means of a central swivel joint, one part of which is attached to the rear of the blade and the companion part is attached to the pusher frame of the earth moving equipment so as to permit up and down movement, pivotal side or angular movement, and edgewise tilting movement of the blade. Various problems occur in the design of such mechanisms, particularly when utilizing the angling provision of the blade. Standard angling dozer blades are considerably wider than the track frames in order to cut a path for both tracks to run in when the blade is angled. This creates a problem when utilizing the blade to cut into a side bank as follows.

When the dozer blade is angled to cut into a bank, one end of the blade takes substantially all of the load which causes the tractor to be forced out of its intended path. This necessitates corrective steering by the operator to keep the tractor on course. To reduce the amount of leverage which twists the tractor when a bank cut is being made, the end of the blade should be in line with the side of the tractor. This is not possible with conventional angling blades because the blade is substantially wider than the tractor to cut a path for the tracks when the blade is angled. Thus, there has been a need for a mechanism having the ability to automatically shift the blade laterally to permit a blade which is shorter than conventional angling blades.

One type of prior art construction provides a guide rail on the back of the blade which has spaced holes for receiving a locking pin, and a portion of the blade frame connection is slidable in the rail. The blade is shifted laterally by removing the locking pin and adjusting it to a desired position and then relocking the pin. Thus, the conventional type arrangements for laterally shifting the blade require complicated mechanical structure, multiple operational steps, and do not permit lateral adjustment of the blade without disconnecting the blade from the support.

These disadvantages of present bulldozer constructions have resulted in the blade shifting construction and controls therefor of the present invention which effectively eliminates the above difficulties of the prior art.

SUMMARY OF THE INVENTION

In accordance with the present invention, an improved mechanical construction and controls are provided for angling, tilting, pitching, and automatically shifting the blade laterally as the blade is angled thereby permitting the use of a blade which is shorter than conventional angling type blades.

The blade adjustment construction and controls of the present invention may be utilized in a conventional bulldozer. The blade is slidably mounted on a slide plate support which is connected by means of a universal swivel joint to the center bight portion of a C-shaped frame. The blade is slidably mounted on the slide plate support by guide plates that permit the blade to slide laterally along the longitudinal extent of the slide plate support to one side or the other of the tractor as the blade is angled.

The C-shaped frame includes laterally spaced push arms which extend rearwardly between the track frames and which are independently pivoted on transverse axes to the frames. The arms of the C-shaped frame constitute the push arms for the blade, and they are forwardly connected by a transverse crossbeam or bight portion extending transversely in front of the vehicle. The blade is raised and lowered by conventional hydraulic actuaters supported on opposite sides of the engine housing and having piston rods pivotally connected to the C-shaped frame.

It is an object of the invention to provide a vertical mast support structure at the center of the bight portion of the C-shaped frame for mounting one end of extensible piston-cylinders used for angling, tilting and pitching. A slider bar which forces the blade to shift laterally on the slide plate support is also connected at one end to the vertical mast.

The angling and pitching control for the slide plate support and blade includes a pair of piston-cylinders with their piston rod ends connected to the vertical mast and their opposed ends connected to the respective sides of the slide plate support. The hydraulic circuitry for the cylinders simultaneously extends the piston rod of one cylinder while retracting the piston rod of the opposing cylinder to angle the slide plate support and bulldozer blade about a vertical axis of the universal joint connecting the slide plate support to the C-shaped frame. Simultaneous extension or retraction of both piston rods causes the slide plate support and blade to pitch about a horizontal axis of the universal joint.

The slide plate support is additionally connected to the top end of the vertical mast structure of the C-shaped frame by means of an extensible tilt cylinder which is disposed parallel to the top edge of the blade. The tilt control includes a piston cylinder with its piston rod end universally pivotally attached to the vertical mast and its opposed end connected to the slide plate support. The vertical pivot axis of the tilt cylinder at the mast is colinear with the vertical pivot axis of the universal joint connecting the slide plate support to the C-shaped frame. The opposed end of the tilt cylinder is universally connected to the slide plate support at a point vertically spaced on the slide plate support above the attachment point of one of the angle-pitch cylinders. The blade adjustment construction provides that when the blade is angled, the blade tilt is not changed.

It is the principal object of the invention to provide a lateral shift mechanism including a slider bar connected between the vertical mast structure and the blade. One end of the slider bar is pivotally mounted for movement about a vertical axis to mounting structure on the vertical mast. The vertical pivot axis of the slider bar on the mast is parallel to and forward of the vertical pivot axis of the universal joint connecting the slide plate support to the C-shaped frame. The other end of the slider bar is pivotally mounted to the back of the blade through a cut-out portion in the slide plate support. The slider bar automatically forces the blade to shift laterally to the exposed side of the tractor when the blade is angled and automatically centers the blade in front of the tractor when the blade is in the straight-ahead position. Thus, the present construction permits the use of a blade which is shorter than conventional angling type blades.

A piston-cylinder may be used instead of the slider bar when additional lateral movement of the blade is desired for casting spoil into a trench without running the tractor as close to the edge of the trench. The added lateral movement provided by the piston-cylinder also permits the blade to reach into a ditch so that the tractor does not have to run in the ditch.

Other advantages and meritorious features of the blade shifting construction and controls of the present invention will be more fully understood from the following description of the preferred embodiment, the appended claims, and the drawings, a brief description of which follows.

DESCRIPTION OF THE PREFERRED EMBODIMENT

Figure 1:
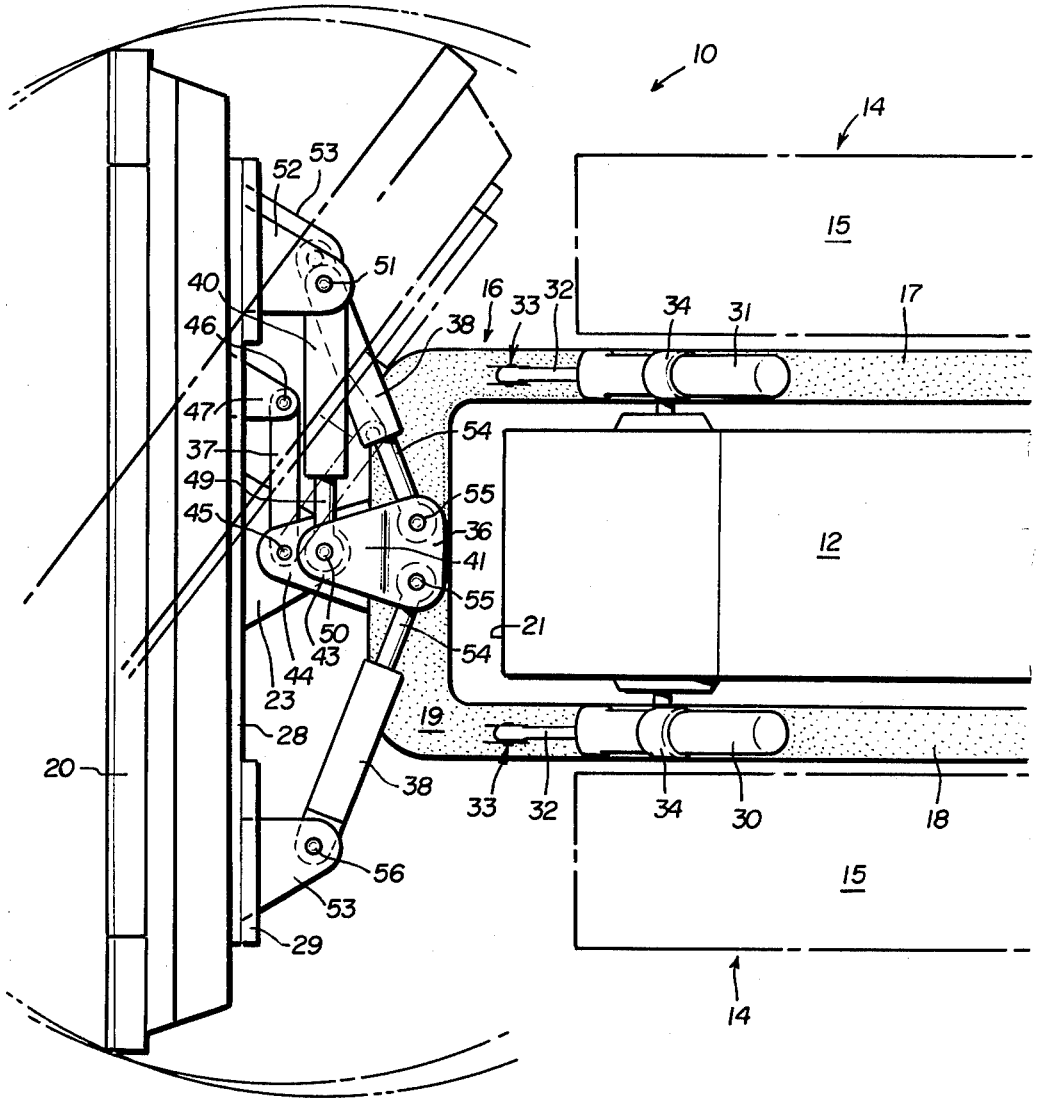
FIG. 1 is a top plan view illustrating the angle-pitch cylinders, tilt cylinder and slider bar mounted on the vertical mast in an earth working vehicle embodying the invention.
Figure 3:
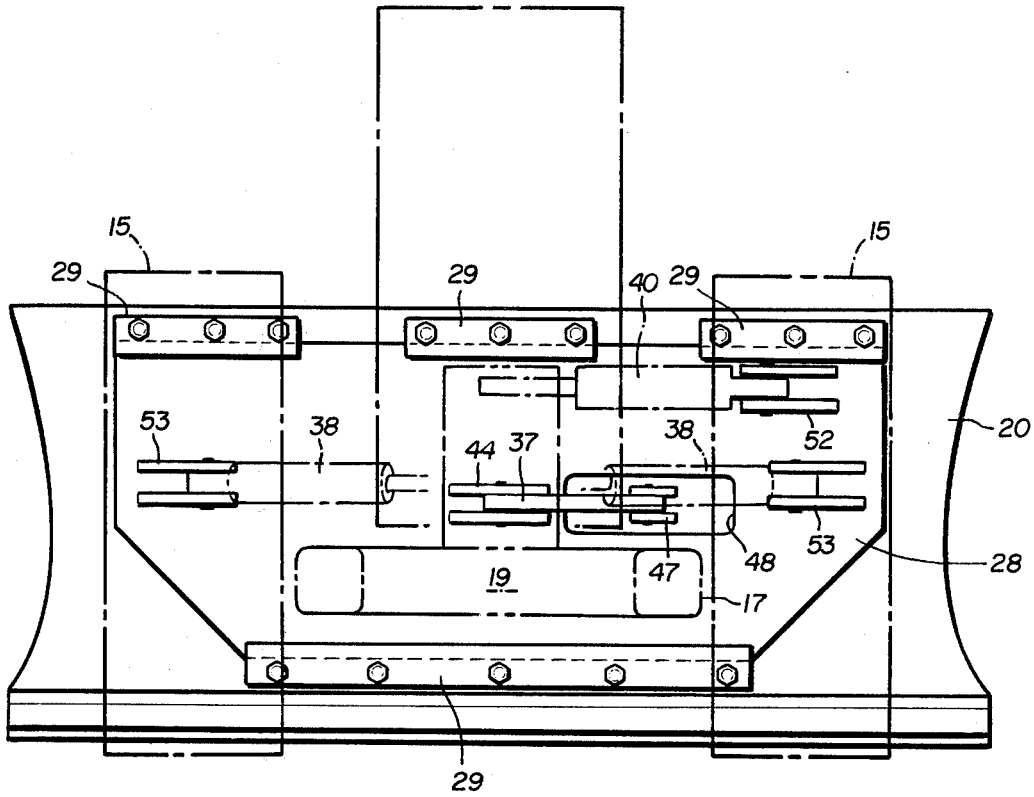
FIG. 3 is a partial rear view of the slide plate support and blade illustrating the slider bar connection to the blade.
Figure 2:
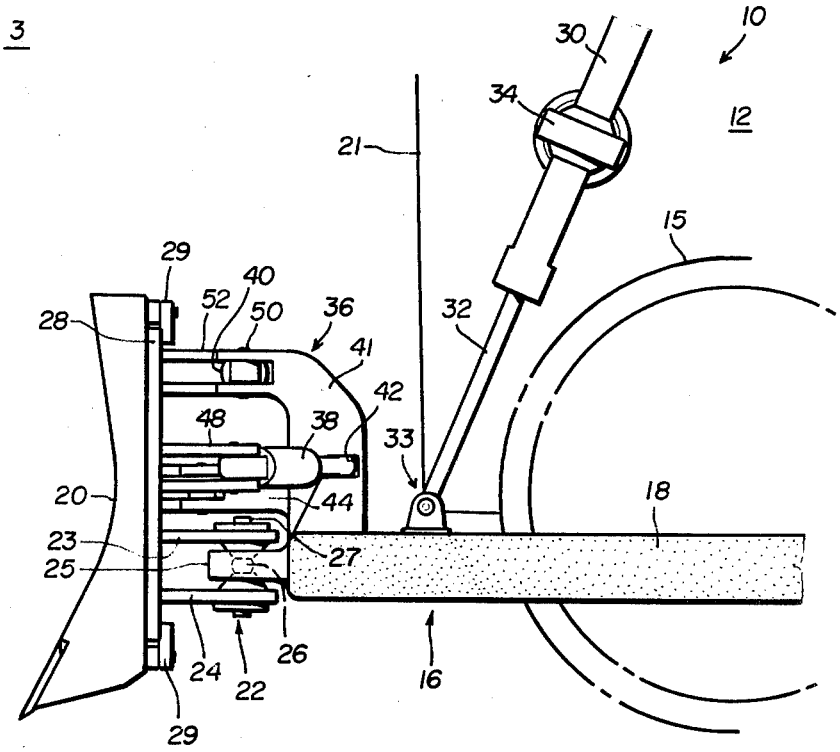
FIG. 2 is a side elevational view of the front part of the vehicle embodying the lateral blade adjustment construction of the present invention.

A preferred embodiment of the earth working vehicle including the laterally adjustable blade construction and controls made in accordance with the teachings of the present invention is illustrated in FIGS. 1–3. The tractor 10 shown in FIG. 1 is seen to include a main frame 12 flanked by a pair of drive track frames 14. As is well known, track roller assemblies (not shown) may be provided on each of the track frames 14 for engaging track chains 15.

The vehicle 10 carries a frame 16 at the forward end thereof, which is substantially C-shaped in a horizontal plane and includes opposite parallel push arms 17 and 18. The free ends of the opposite parallel arms 17 and 18 extend longitudinally along inner sides of the drive track frames 14 and are pivotally connected thereto by means of transverse axially aligned pivot shafts to enable the frame 16 to be raised or lowered relative to a ground surface on which the vehicle is disposed. The forward ends of the parallel arms 17 and 18 are connected by a transverse bight portion 19.

The bulldozer includes a conventional transverse scraper blade 20 slidably mounted forwardly of the front end 21 of the frame 12 on slide plate support 28. Slide plate support 28 is pivotally supported on the bight portion 19 of the frame 16 by means of a universal swivel joint 22 preferably of the ball and socket type so as to permit universal movement of the slide plate support and blade 20 about a horizontal and a vertical axis within the ball and socket connection. Blade 20 is slidably mounted on the slide plate support 28 by guide plates 29 that permit the blade to slide laterally to one side or the other of the tractor on the slide plate support as the blade is angled. Guide plates 29 are bolted to the blade 20, and they extend over the peripheral edges of the slide plate support 28 to permit slidable movement by blade 20 along the longitudinal extent of the slide plate support 28.

The ball and socket connection 22 as illustrated in FIG. 2, comprises a horizontally positioned upper ear 23 and a lower ear 24 opposed from each other and projecting from the rear of the slide plate support 28. Each ear 23 and 24 has a vertical bore which is axially aligned with the bore in the opposed ear. An arcuate plate 25 extends forwardly from the center of the bight portion 19 and is positioned between the ears 23 and 24. A swivel ball 26 is mounted on pin 27 within a bore of the arcuate plate 25. The arrangement of the swivel ball 26 allows the rotation of the slide plate support 28 and bulldozer blade 20 about horizontal and vertical axes within the ball and socket connection.

The blade is raised and lowered by conventional hydraulic actuators or lift cylinders 30 and 31 supported on opposite sides of the engine housing and having piston rods 32 pivotally connected by means of clevis-type connections 33 mounted on the push arms 17 and 18. The hydraulic lift cylinders 30 and 31 are suitably secured within trunnion mountings 34 mounted to the side walls of the frame 12 such that they have complete freedom of movement in any direction.

FIGS. 1 and 2 illustrate the "f" shaped vertical mast support structure 36 which forms part of the present invention and supports one end of slider bar 37, one end of angle-pitch cylinders 38 and one end of tilt cylinder 40. As illustrated, the vertical mast structure 36 extends vertically upwardly from the center of the bight portion 19 of the C-shaped frame 16. The vertical mast has a top end portion 41 which extends outwardly from the forward end ofthe C-shaped frame 16 and is vertically spaced directly above the universal joint 22. Mounting lugs 42 are formed on opposite sides of the vertical mast approximately midway of its longitudinal extent. These mounting lugs secure one end of the respective angle-pitch cylinders 38. The cantilevered top end portion 41 is also provided with a mounting portion 43 for securing one end of the tilt cylinder 40.

The slider bar 37 is pivotally attached at one of its ends by pin 45 to mounting portion 44 on vertical mast 36. The opposite end of slider bar 37 is pivotally mounted by pin 46 to lugs 47 which are welded on the backside of blade 20 and they extend through cut-out portion 48 in slide plate support 28. The extent of lateral movement by the blade 20 to either side of the slide plate support 28 is limited by the engagement of lugs 47 with the ends of cut-out portion 48. The slider bar 37 may be replaced by a piston-cylinder to enable an operator to shift the blade to the side without angling the blade.

The tilt cylinder 40 is disposed parallel to the upper end of the blade 20, and it has a rod end 49 universally pivotally secured to mounting portion 43 of vertical mast 36 by pin 50. Its opposite end is universally pivotally mounted by pin 51 to lugs 52 which are welded on the backside of slide plate support 28. The pivot axis 50 of tilt cylinder 40 is directly above and colinear with the vertical pivot axis defined by the universal swivel connection 22 about pin 27. Pivot axis 50 is directly above the universal joint 22 so that a set grade angle is not changed by angling of the blade. Once the operator sets the tilt of the blade, the blade can be angled without requiring a readjustment of tilt cylinder 40 to recapture the desired grade angle.

The angle-pitch controls include one piston-cylinder 38 on the left hand side of the slide plate support 28 and a second cylinder 38 identical in construction, mounting and operation to the first, on the right hand side of the slide plate support. The cylinders are connected between mounting lugs 53 welded on the back side of the slide plate support 28 and mounting lugs 42 on the vertical mast support structure 36. The piston rod 54 of each angle-pitch cylinder is universally pivotally connected by a vertical pin 55 to the mounting lugs 42 on the vertical mast structure, and the opposite end of each angle-pitch cylinder is universally pivotally mounted to lugs 53 on the back of slide plate support 28 by vertical pin 56.

The angle-pitch motors 38 are controlled by a hydraulic system which is manipulated for placing the angle-pitch cylinders in series or parallel. When the cylinders are placed in series, the piston rod of one angle-pitch cylinder is extended and the piston rod of the other cylinder is retracted to adjust the angle of the dozer blade 20 relative to the vertical axis defined by the swivel connection 22. The hydraulic control may also be manipulated to connect the cylinders in parallel whereby both piston rods are extended or both are retracted, in unison, for pitching the blade relative to the horizontal axis defined by the swivel connection 22.

The tilt control is adjustable such that as piston rod 49 is extended outwardly from tilt cylinder 40, a downwardly push is exerted on the upper edge of the slide plate support 28 nearest to the piston and an upward pull is exerted on the lower edge of the slide plate support, diagonally positioned therefrom to rotate the slide plate support and blade about the longitudinal axis of the universal swivel 22, thereby tilting the blade to the right. Conversely, when the piston rod 49 is retracted within the tilt cylinder 40, the slide plate support and blade are caused to rotate about a longitudinal axis of the universal swivel joint 22 in the opposite direction tilting the slide plate support and blade to the left.

The present invention requires no complex hydraulic circuitry or linkage arrangements to accomplish the desired blade adjustment and blade shifting. The hydraulic system for angling, pitching and tilting the blade is disclosed in my copending application Ser. No. 953,827 which is incorporated by reference herein. By the present arrangement, the blade can be tilted without angling the blade; angled without tilting the blade; or angled and tilted in a plurality of positions. When the blade 20 is tilted in a certain position, the change in the blade angle does not change the blade tilt.

The operation of the lateral shift mechanism for automatically shifting the blade to the exposed side of the tractor as the blade is angled is as follows. The vertical pivot axis 45 of the slider bar 37 on mast 36 is parallel to and forward of the vertical pivot axis 27 of the universal joint 22 connecting the slide plate support 28 to the C-shaped frame. When one of the angle-pitch cylinders 38 is extended and the other cylinder is retracted to adjust the angle of the dozer blade 20, the slider bar 37 automatically forces the blade to shift laterally on the slide plate support 28 to the exposed side of the tractor. The extent of lateral movement by the blade 20 to either side of the tractor is limited by the cut-out portion 48 in slide plate support 28. The slider bar 37 may be modified by replacing it with a hydraulic cylinder (not shown) to enable an operator to slide the blade to the side of the tractor most advantageous to a particular situation. Thus, the present invention forces the blade to shift laterally on the slide plate support to the exposed side of the tractor automatically as the blade is angled thereby keeping the blade in front of the tractor for cutting a path wide enough for the tracks and permitting the use of a much shorter than conventional angling blade.

It will be apparent to those skilled in the art that the foregoing disclosure is exemplary in nature rather than limiting, the invention being limited only by the appended claims.

We claim:

1. In an earth-working vehicle, a frame comprising a generally C-shaped structure having opposed arms, the free ends of said arms being connected to said vehicle, the other ends of said arms being connected by a transverse cross-beam the improvement comprising:

a slide plate support, means for universally mounting said slide plate support on the forward end of said transverse cross-beam;

guide plate means slidably mounting a ground-engaging blade on said slide plate support to permit said blade to slidably move along the longitudinal extent of said slide plate support;

a vertical mast upstanding from said transverse cross-beam;

a pair of piston-cylinders connected at one of their ends to said vertical mast and their opposed ends being pivotally connected to respective sides of said slide plate support; and a slider bar pivotally connected at one of its ends to said vertical mast and pivotally connected at its other end to said blade through an opening in said slide plate support, said slider bar forcing said blade to shift laterally on said slide plate support as said blade is angled.

2. The earth-working vehicle as defined in claim 1 wherein said means for universally mounting said slide plate support on said cross-beam permits angular adjustment of said blade about intersecting vertical, horizontal, and longitudinal axes, said pivotal connection of said slider bar to said mast being parallel to and forward of said vertical axis of said universal pivot means.

3. The earth-working vehicle as defined in claim 2 wherein the pivotal connection between said slider bar and said blade includes means which is mounted to said blade and passes through said opening in said slide plate support, the lateral shifting of said blade on said slide plate support being limited by the engagement of said means with the ends of said opening.

4. A mechanism for automatically laterally shifting a blade of an earth-working vehicle having a blade supporting frame, said frame being of substantially C-shaped configuration comprising a pair of parallel arms pivotally connected to said vehicle at their free ends and a transverse bight portion connecting the other ends of said arms in front of said vehicle, said transverse bight portion supporting a slide plate support, guide plate means slidably mounting said blade on said slide plate support to permit said blade to slidably move along the longitudinal extent of said slide plate support, means for universally pivotally connecting said slide plate support to said bight portion at the center thereof midway between the ends of said blade and adjacent the lower edge thereof to permit angular adjustment of said slide plate support and blade about intersecting vertical, horizontal and longitudinal axes, a vertical mast upstanding from said transverse bight portion, a pair of piston-cylinders pivotally connected at one of their ends to said vertical mast and their opposed ends pivotally connected to respective sides of said slide plate support, said pair of piston-cylinders being adjustable to thereby cause angling of said slide plate support and blade about a vertical axis when said cylinders are longitudinally moved in opposite directions, and an extensible link disposed generally parallel to the top edge of said blade and being pivotally attached at one end to mounting means on said vertical mast and at its other end to mounting means on one side of said blade, said mounting means on said blade passing through an opening in said slide plate support, selective extension or contraction of said extensible link forcing said blade to laterally shift on said slide plate support.

* * * * *